US006891318B2

(12) United States Patent
Hori et al.

(10) Patent No.: US 6,891,318 B2
(45) Date of Patent: May 10, 2005

(54) STRUCTURE OF SPARK PLUG DESIGNED TO PROVIDE HIGHER DURABILITY AND FABRICATION METHOD THEREOF

(75) Inventors: Tsunenobu Hori, Kariya (JP); Akihiko Mizutani, Kuwana (JP); Hironori Osamura, Chiryu (JP); Kozo Takamura, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/218,513

(22) Filed: Aug. 15, 2002

(65) Prior Publication Data

US 2003/0038577 A1 Feb. 27, 2003

(30) Foreign Application Priority Data

Aug. 27, 2001 (JP) ..... 2001-256151

(51) Int. Cl.[7] ..... H01T 13/20
(52) U.S. Cl. ..... 313/141; 313/118
(58) Field of Search ..... 313/141, 140, 313/143, 118, 139; 445/7

(56) References Cited

U.S. PATENT DOCUMENTS 5,736,809 A * 4/1998 Matsutani et al. ..... 313/141
6,078,129 A 6/2000 Gotou et al.
6,215,235 B1 4/2001 Osamura
2002/0017846 A1 2/2002 Hori
2002/0105254 A1 8/2002 Hori

FOREIGN PATENT DOCUMENTS

| | | |
|---|---|---|
| EP | 0 936 710 A1 | 8/1999 |
| EP | 1 133 037 A2 | 9/2001 |
| JP | 6-188062 | 7/1994 |
| JP | 6-262384 | 9/1994 |
| JP | 11-3765 | 1/1999 |

* cited by examiner

*Primary Examiner*—Joseph Williams
(74) *Attorney, Agent, or Firm*—Nixon & Vanderhye P.C.

(57) ABSTRACT

An improved structure of a spark plug which provides higher durability of a joint of a noble metal chip to an electrode such as a center or a ground electrode. The joint is formed by laser welding. A fused portion made of materials of the noble metal chip and the electrode fused together by the laser welding is formed in the joint so that it may continue over at least half a circumference of a contact between the noble metal chip and the electrode without interfaces of welds, thereby enhancing the activity of the fused portion as a thermal stress absorber. A welding method is also provided.

15 Claims, 13 Drawing Sheets

STRUCTURE OF SPARK PLUG DESIGNED TO PROVIDE HIGHER DURABILITY AND FABRICATION METHOD THEREOF

BACKGROUND OF THE INVENTION

1. Technical Field of the Invention

The present invention relates generally to a spark plug which may be employed in automotive engines, and more particularly to an improved structure of a spark plug with a noble metal chip welded to at least one of a center electrode and a ground electrode which provides higher durability at a joint of the noble metal chip to the one of the center and ground electrodes, and a fabricating method thereof.

2. Background Art

There are known spark plugs with a noble metal chip welded to at least one of a center or a ground electrode. Japanese Patent First Publication No. 6-188062 teaches, as illustrated in FIGS. 27 and 28, irradiating a laser beam at given time intervals to a contact between a noble metal chip 2*a* and an electrode 2 rotating together to form a plurality of spot welds 200, as shown in FIGS. 29 and 30, which are made of materials of the noble metal chip 2*a* and the electrode 2 melted together. Each of the sport welds partially overlaps an adjacent one, thereby forming a complete annular alloy band extending over the whole of a circumference of the contact between the noble metal chip 2*a* and the electrode 2.

The above laser welding, however, encounters drawbacks in that much time is consumed in irradiating the laser beam to the noble metal chip 2*a* rotating together with the electrode 2 to form the spot welds 200 over an overall circumference of the contact between the noble metal chip 2*a* and the electrode 2, thus resulting in an increase in manufacturing cost of the spark plugs. Additionally, misalignment of the noble metal chip 2*a* with the electrode 2 will result in a variation in focus of the laser beam on a plurality of portions of the contact between the noble metal chip 2*a* and the electrode 2 to be spot-welded, thereby causing, as shown in FIG. 30, discrete interfaces 201 to be formed between the spot welds 200 which result in an increase in thermal stress acting on an interface between the noble metal chip 2*a* and each of the spot welds 200.

Further, in modern engines, a combustible atmosphere is elevated in temperature for increasing an output and reducing a fuel consumption and exhaust emissions. In this type of engine, a park plug is subjected to an intense heat, so that the temperature of center and ground electrodes is increased greatly. The electrodes, therefore, undergo a thermal stress and oxidation, which may cause noble metal chips to be removed from the center and ground electrodes.

SUMMARY OF THE INVENTION

It is therefore a principal object of the invention to avoid the disadvantages of the prior art.

It is another object of the invention to provide a structure of a spark plug designed to improve the reliability of a weld of a noble metal chip to at least one of a center electrode and a ground electrode and also to provide a noble metal chip-welding method thereof.

According to one aspect of the invention, there is provided a higher durability spark plug which may be employed in automotive engines. The spark plug comprises: (a) a first electrode; (b) a second electrode opposed to the first electrode through a given air gap; (c) a noble metal member being in contact of a preselected portion thereof with a preselected portion of at least one of the first and second electrodes, the noble metal member being joined at a contact between the preselected portions with the one of the first and second electrodes by laser welding; and (d) a fused portion that forms a weld between the noble metal member and the one of the first and second electrodes and is made of materials of the noble metal member and the one of the first and second electrodes fused together by the laser welding. The fused portion continues over at least half a circumferential direction of the contact between the preselected portions of the noble metal member and the one of the first and second electrodes without interfaces of welds.

In the preferred mode of the invention, the fused portion may continue over an overall circumference of the contact between the preselected portions of the noble metal member and the one of the first and second electrodes.

If a sectional area of the noble metal chip closest to the fused portion is defined as A, an area of a portion of the contact between the preselected portions of the noble metal member and the one of the first and second electrodes which is unfused by the laser welding is defined as B, a percentage, as expressed by $(B/A)\times 100$, is 50% or less.

A second fused portion is further provided which is made of materials of the noble metal member and the fused portion fused together by laser welding. The second fused portion extends into an interface between the fused portion and the noble metal member.

The noble metal chip is made of an Ir alloy containing at least 50 Wt % of iridium.

According to the second aspect of the invention, there is provided a method of joining a noble metal member to at least one of first and second electrodes opposed to each other through a given air gap. The method comprises the step of: (a) placing the noble metal member at a preselected portion thereof on a preselected portion of the one of the first and second electrodes in contact therewith; and (b) irradiating a plurality of laser beams simultaneously over at least half a circumferential direction of a contact between the preselected portions of the noble metal member and the one of the first and second electrodes.

In the preferred mode of the invention, the irradiating step irradiates the laser beams simultaneously over an overall circumference of the contact between the preselected portions of the noble metal member and the one of the first and second electrodes.

According to the third aspect of the invention, there is provided a method of joining a noble metal member to at least one of first and second electrodes opposed to each other through a given air gap. The method comprises the step of: (a) placing the noble metal member at a preselected portion thereof on a preselected portion of the one of the first and second electrodes in contact therewith; and (b) irradiating a single annular laser beam over at least half a circumferential direction of a contact between the preselected portions of the noble metal member and the one of the first and second electrodes.

In the preferred mode of the invention, the irradiating step irradiates the annular laser beam over an overall circumference of the contact between the preselected portions of the noble metal member and the one of the first and second electrodes.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
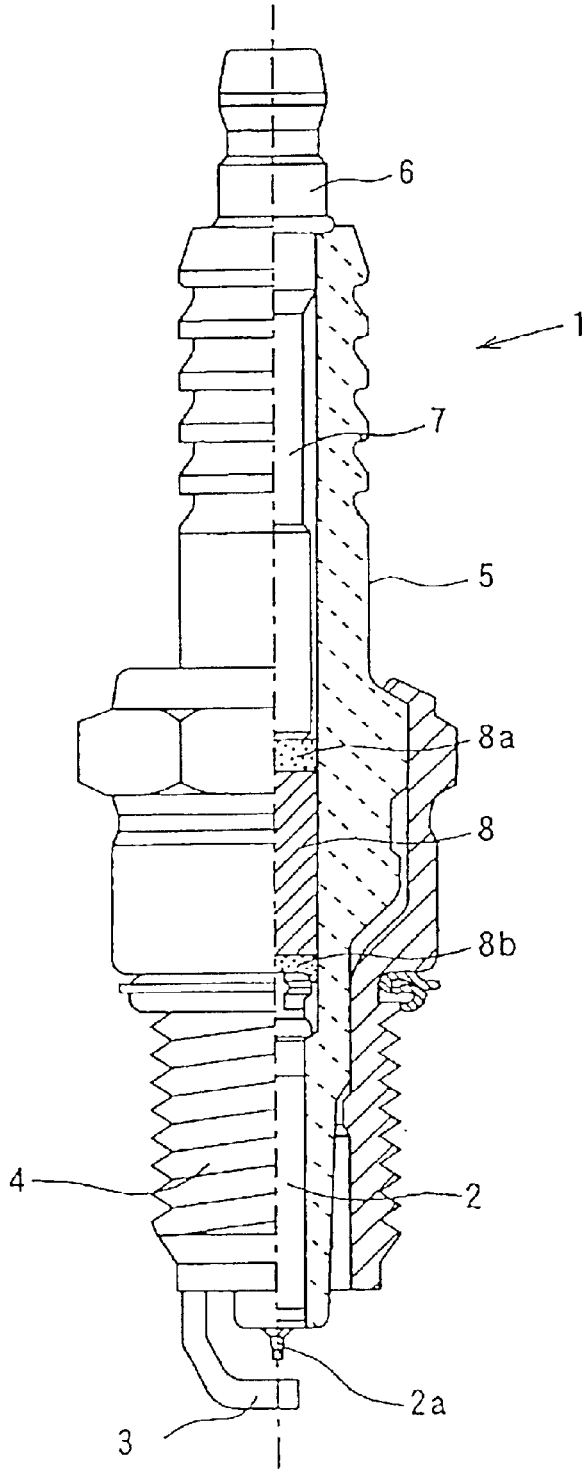
FIG. 1 is a partially sectional view which shows a spark plug with a noble metal chip according to the first embodiment of the invention.

Referring to the drawings, wherein like reference numbers refer to like parts in several views, particularly to FIGS. 1 to 5, there is shown a spark plug 1 which may be used in internal combustion engines for automotive vehicles.

The spark plug 1 includes a cylindrical metal shell (housing) 4, a porcelain insulator 5, a center electrode 2, a ground electrode 3, a metallic stem 7, and a resistor 8. The metal shell 4 is made of a conductive iron steel such as a low carbon steel and has cut therein a thread for mounting the spark plug 1 in an engine block (not shown). The porcelain insulator 5 made of an alumina ceramic ($Al_2O_3$) is retained within the metal shell 4 and has a tip exposed inside the metal shell 4. The stem 7 has a terminal 6. The resistor 8 has a given resistance value and is disposed between the stem 7 and the center electrode 2 within the porcelain insulator 5. The ground electrode 3 has a tip facing a tip of the center electrode 2 extending from the porcelain insulator 5 to define a spark gap within which a sequence of sparks are produced.

The center electrode 2 is secured in a central chamber of the porcelain insulator 5 and insulated electrically from the metal shell 4. The center electrode 2 is formed by a cylindrical member which is made up of a core portion made of a metallic material such as Cu having a higher thermal conductivity and an external portion made of a metallic material such as an Ni-based alloy having higher thermal and corrosion resistances. A noble metal chip 2*a* made of, for example, iridium is laser-welded to the end the center electrode 2.

The ground electrode 3 is made of an Ni alloy whose main component is nickel and welded at a base thereof directly to an end of the metal shell 4. The ground electrode 3 is, as clearly shown in FIG. 1, bent to an L-shape at approximately 90° to have the tip thereof opposed to the noble metal chip 2*a* of the center electrode 2 through the spark gap.

The resistor 8 is made of a cylindrical member formed by sintering a mixture of carbon powder and glass powder that is a main component within a furnace. Seal members 8*a* and 8*b* made of a conductive glass material are installed on opposed ends of the resistor 8 to insulate the center electrode 2 (i.e., the inside of a combustion chamber of the engine) from the terminal 6 (i.e., the outside of the combustion chamber).

Joining of the metal shell 4 and the porcelain insulator 5 is accomplished by elastically deforming or staking a peripheral end of the metal shell 4 on the porcelain insulator 5 after the resistor 8 is installed within the porcelain insulator 5.

Joining the noble metal chip 2*a* to the end of the center electrode 2 is achieved in the first embodiment of the invention by a unique laser welding method which will be discussed below with reference to FIGS. 2 and 3. Arrows, as illustrated in FIGS. 3 and 4 indicate directions of irradiation of laser beams 100.

Figure 2:
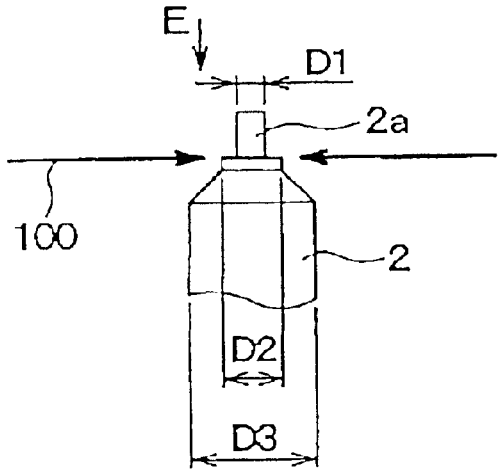
FIG. 2 is a partially enlarged view which shows laser welding according to the first embodiment of the invention.
Figure 3:
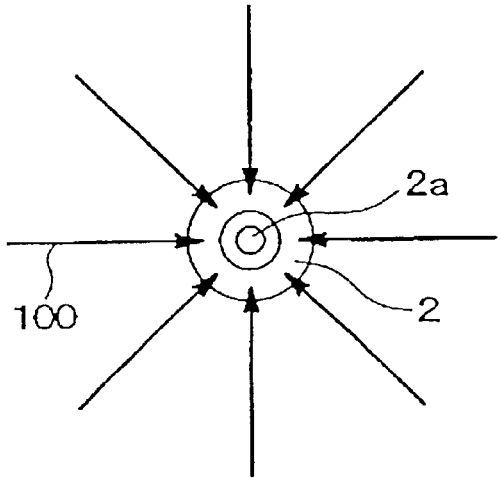
FIG. 3 is a top view as viewed from an arrow E in FIG. 2.

First, the noble metal chip 2*a* is, as shown in FIG. 2, placed at an end thereof on the end of the center electrode 2. Subsequently, a plurality of laser beams 100 are irradiated simultaneously around a contact between the ends of the noble metal chip 2*a* and the center electrode 2 at regular angular intervals to fuse the end of the noble metal chip 2*a* arid the end of the center electrode 2. For example, eight laser beams 100 are, as clearly shown in FIG. 3, irradiated simultaneously at intervals of 40°. This welding will be referred to as multi-spot simultaneous welding below.

Figure 4:
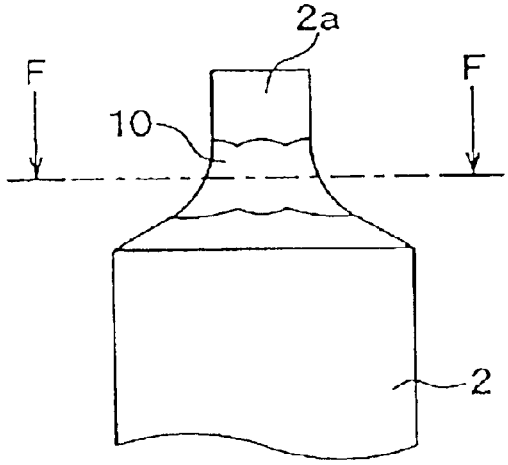
FIG. 4 is a partially enlarged view which shows a weld between a noble metal chip and a center electrode.
Figure 5:
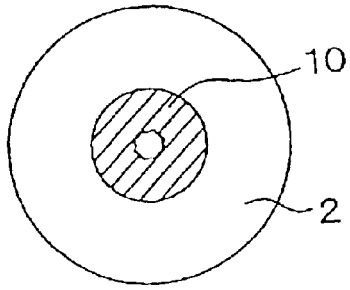
FIG. 5 is a sectional view taken along the line F—F in FIG. 4.

FIGS. 4 and 5 illustrate a weld between the noble metal chip 2*a* and the center electrode 2 which will also be referred to below as a fused portion 10 formed by materials of the noble metal chip 2*a* and the center electrode 2 melted together by the multi-spot simultaneous welding. The multi-spot simultaneous welding is, as described above, achieved by irradiating the laser beams 100 simultaneously from different directions over the whole of a circumferential direction of the contact between the noble metal chip 2*a* and the center electrode 2, therefore, the overall circumference of the contact is melted and solidified instantaneously, thereby resulting in continuity of the fused portion 10 over the overall circumference of the contact without formation of interfaces between spot welds each of which is made by one of the laser beams 100.

Figure 6:
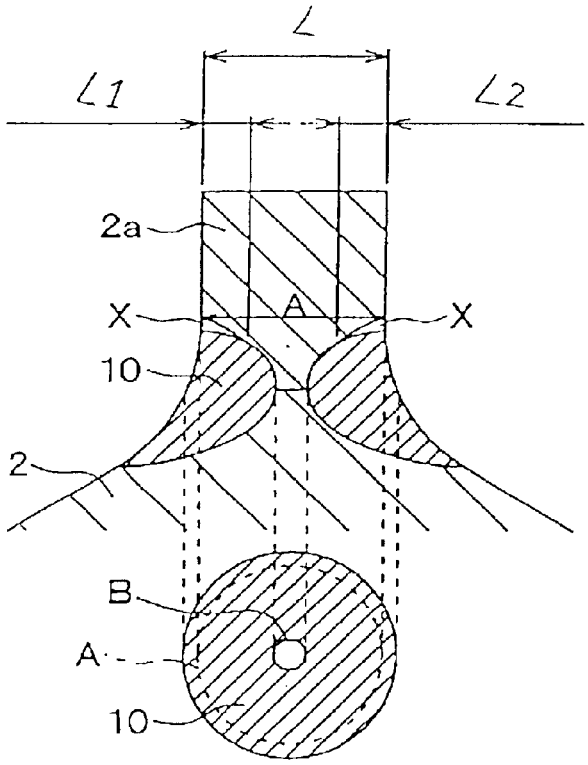
FIG. 6 is a partially longitudinal sectional view which shows an internal structure of a weld between a noble metal chip and a center electrode.
Figure 27:
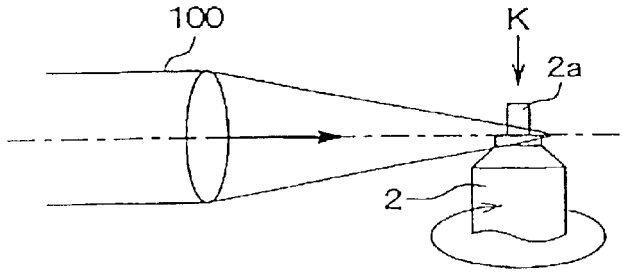
FIG. 27 PRIOR ART
FIG. 27 is a side view which shows conventional laser welding.
Figure 28:
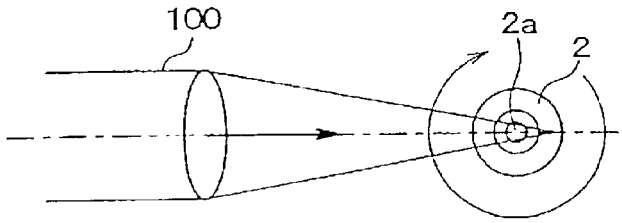
FIG. 28 PRIOR ART
FIG. 28 is a top view as viewed from an arrow K in FIG. 27.
Figure 29:
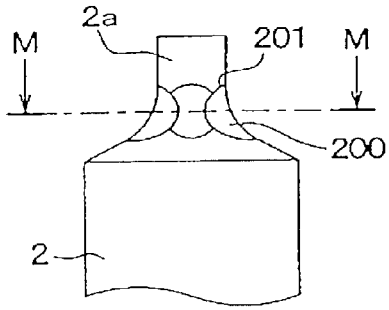
FIG. 29 PRIOR ART
FIG. 29 is a side view which shows a weld between a noble metal chip and an electrode formed by the laser welding of FIG. 27.
Figure 30:
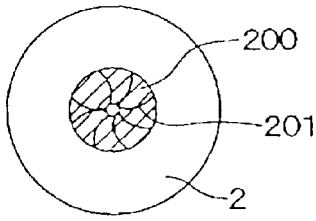
FIG. 30 PRIOR ART
FIG. 30 is a transverse sectional view taken along the line M—M in FIG. 29.

We prepared two kinds of spark plug samples: one having the noble metal chip 2*a* welded to the center electrode 2 in the conventional manner, as discussed in the introductory part of this application with reference to FIGS. 27 and 28, and the second having the noble metal chip 2*a* welded to the center electrode 2 by the multi-spot simultaneous welding and performed durability tests on them. After the durability tests, we evaluated the durability of the spark plug samples in terms of a percentage of an interface X, as illustrated in FIG. 6, of the fused portion 10 separated from the noble metal chip 2*a* (will also be referred to as a fused portion separation percentage below) and a percentage C of a sectional area of an unwelded or unfused portion that is a central contact between the noble metal chip 2*a* and the end of the center electrode 2 (will be referred to as an unfused sectional area percentage below). The fused portion separation percentage is expressed mathematically by $\{(L1+L2)/L\}\times 100$ (%) where L indicates, as shown in FIG. 6, a maximum distance between opposed edges of an end of the fused portion 10 adjacent the noble metal chip 2*a* (i.e., the diameter of the contact between the noble metal chip 2*a* and the center electrode 2 in this embodiment), and L1 and L2 indicate lengths of the separated interface X in a direction of diameter of the noble metal chip 2*a*. The unfused sectional area percentage C is expressed mathematically by $(B/A)\times 100$ (%) where A is a transverse sectional area of the noble metal chip 2*a* closest to the fused portion 10, and B is an area of the central contact between the noble metal chip 2*a* and the end of the center electrode 2, that is, an unfused area occupying inside the fused portion 10.

For dimensions of the spark plug samples employed in the durability tests, the diameter D1, as shown in FIG. 2, of the noble metal chip 2*a* is 0.7 mm. The length of the noble metal chip 2*a* is 0.8 mm. The noble metal chip 2*a* is made of an Ir alloy containing 90 Wt % of Ir (iridium) and 10 Wt % of Rh (rhodium). The diameter D2 of a seat (i.e., the end) of the center electrode 2 on which the noble metal chip 2*a* is welded is 1.2 mm. The thickness of the seat is 0.3 mm. The diameter D3 of a body of the center electrode 2 is 2.7 mm. The center electrode 2 is made of Inconel (trade mark).

The durability tests were made by idling a 6-cylinder 2000 cc engine in which the spark plug samples were installed at 8000 rpm. for one minute and then running it at a full speed of 6000 rpm. for one minute. This cycle was repeated for 100 hours.

Figure 7:
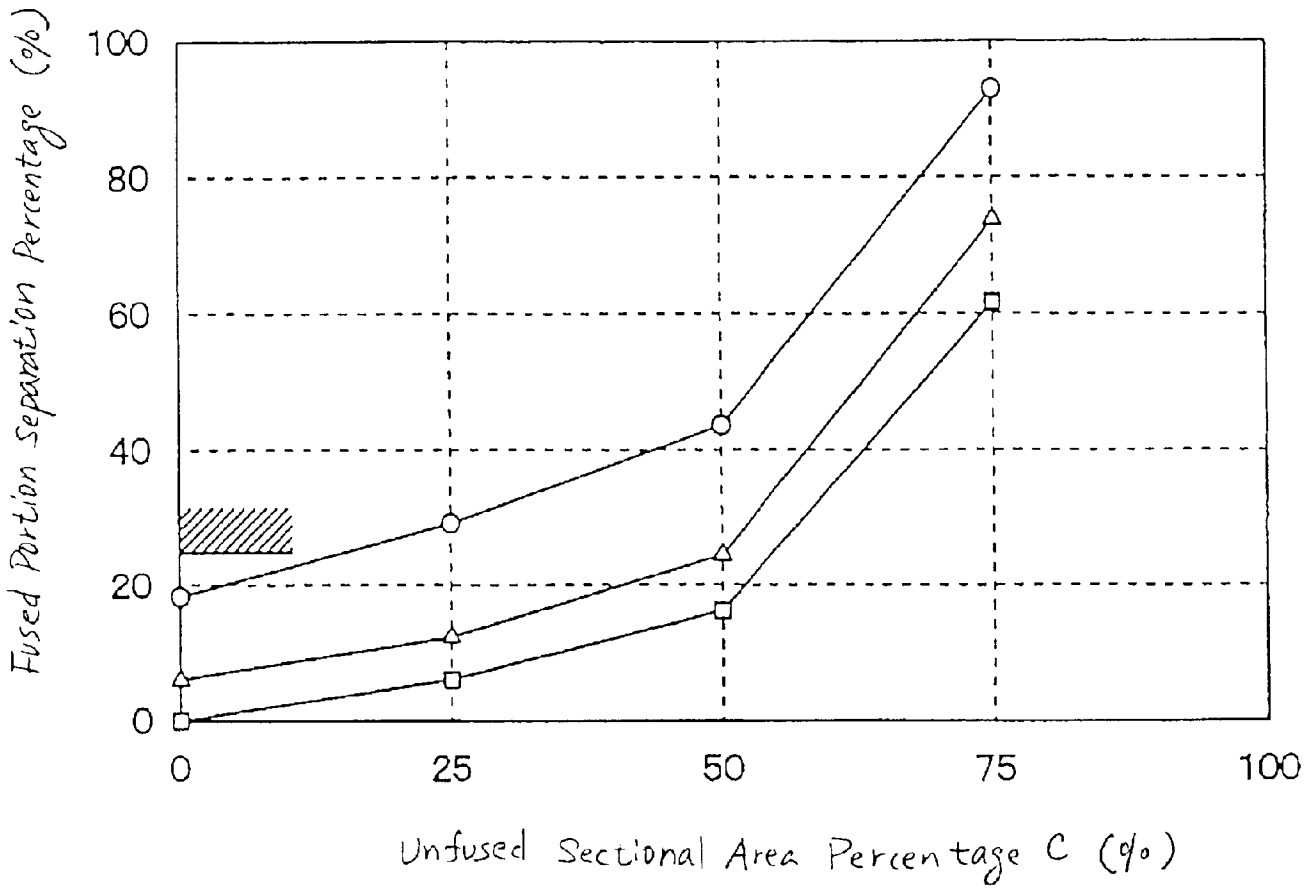
FIG. 7 is a graph which represents a separation percentage of a portion of an interface between a noble metal chip and a weld which is separated after durability tests for different values of a unwelded area.

FIG. 7 is a graph which represents results of the durability tests. The graph indicates values of the fused portion separation percentage when the unfused sectional area percentage C is 0%, 25%, 50%, and 75%. "○" denotes the spark plug samples in which the noble metal chip 2*a* is welded by the conventional manner and which will also be referred to as conventional spark plug samples below. "Δ" denotes the spark plug samples in which the noble metal chip 2*a* is welded by the multi-spot simultaneous welding and which will also be referred to as embodiment spark plug samples below.

The graph clearly shows that the embodiment spark plug samples are lower in the fused portion separation percentage than the conventional spark plug samples. This is because the fused portion 10 continues over the circumferential direction of the contact between the noble metal chip 2*a* and the center electrode 2, thus resulting in no thermal stress which would be produced in an interface between adjacent two of welds of the noble metal chip 2*a* with the center electrode 2 in the conventional structure.

The inventors of this application have studied and confirmed that the spark plug samples whose fused portion separation percentage is less than or equal to 25% may be employed in practical applications. It will, thus, be apparent from the graph that when the unfused sectional area percentage C is less than or equal to 50%, the embodiment spark plug samples will have a desired strength of the weld of the noble metal chip 2*a* with the center electrode 2. This is because the activity of the fused portion 10 as a thermal stress absorber is enhanced when the unfused sectional area percentage C is less than or equal to 50%. Of course, it is evident that when the unfused sectional area percentage C is zero (i.e., B=0), the fused portion separation percentage will be zero (0) which provides the highest strength of the joint between the noble metal chip 2*a* and the center electrode 2.

The joining of the noble metal chip 2*a* to the center electrode 2 may alternatively be achieved by performing the multi-spot simultaneous welding two times. For instance, the laser beams 100 may be radiated simultaneously over 270° of a circumference of the contact between the noble metal chip 2 and the center electrode 2 in the first step, and the remainder of the circumference may be welded in a following step. This also results in a decrease in time required for welding the noble metal chip 2*a* to the center electrode 2 as compared with the conventional welding, as discussed in the introductory part of this application, which requires a laser welding operation at least three times.

The eight laser beams 100 are used in the multi-spot simultaneous welding of this embodiment, but however, the number of the laser beams 100 is changed preferably depending upon the size and/or shape of the noble metal chip 2*a*. It is not always necessary to weld the overall circumference of the contact between the noble metal chip 2*a* and the center electrode 2. It is preferable that at least half a circumference of the noble metal chip 2*a* is welded to the center electrode 2.

Figure 8:
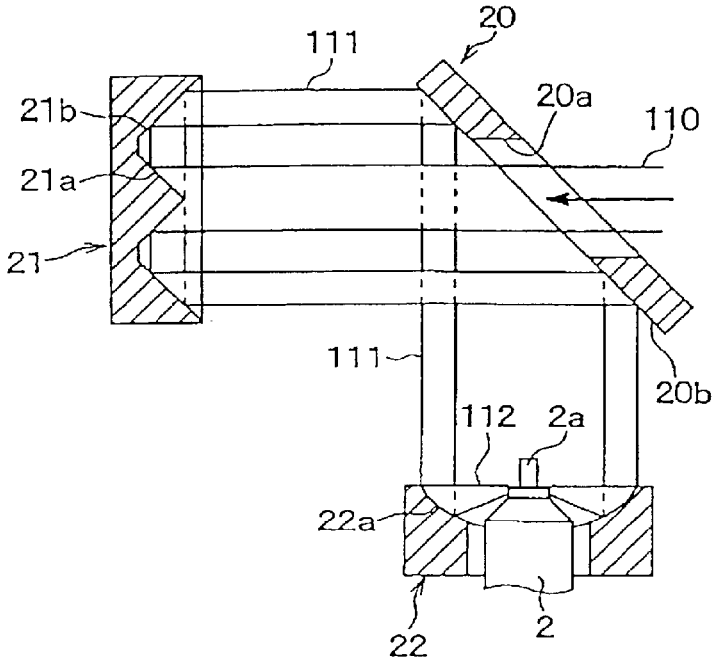
FIG. 8 is a plan view which shows an optical system used in laser welding according to the second embodiment of the invention.

FIG. 8 shows an optical system used in laser welding according to the second embodiment of the invention which consists essentially of a reflective mirror plate 20, a conical reflective mirror 21, and a condenser mirror 22.

The reflective mirror plate 20 has an opening or window 20*a* formed in a central portion thereof. The conical mirror 21 has a substantially V-shaped annular groove formed in a major surface thereof to define a central conical reflective surface 21*a* and a peripheral conical reflective surface 21*b*. The condenser mirror 22 has a domed concave reflective surface 22*a*.

A laser beam 110 which is produced by a laser oscillator (not shown) passes through the window 20*a* of the reflective mirror plate 20 and travels to a central area of the central conical reflective surface 21*a* of the conical reflective mirror 21. The laser beam 110 is reflected on the central conical reflective surface 21*a* so that it is expanded outwardly and directed to the peripheral conical reflective surface 21*b*. The laser beams 110 is reflected on the peripheral conical reflective surface 2*b* and returned to a flat reflective surface 20*b* of the mirror plate 20, so that it is emitted to the condenser mirror 22 as an annular leaser beam 111 that is uniform in energy density in a circumferential direction thereof.

The annular laser beam 111 is reflected on the concave reflective surface 22*a* of the condenser mirror 22 and radiated as an annular condensed laser beam 112 to an overall circumference of a contact between ends of the noble metal chip 2*a* and the center electrode 2 to be welded. This welding will be referred to as annular beam welding below.

Figure 9:
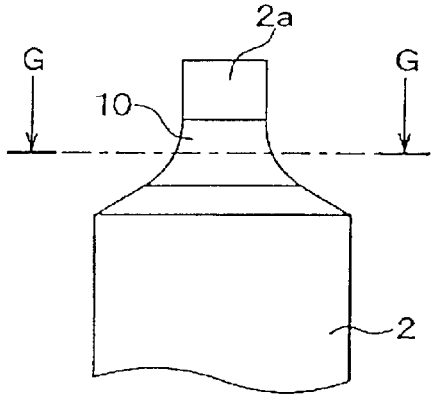
FIG. 9 is a partially enlarged view which shows a weld between a noble metal chip and a center electrode formed by the optical system of FIG. 8.
Figure 10:
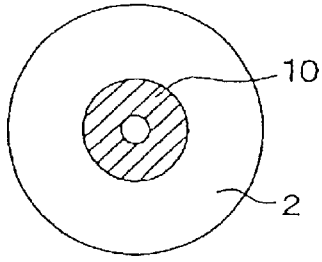
FIG. 10 is a sectional view taken along the line G—G in FIG. 9.

FIGS. 9 and 10 illustrate a joint between the noble metal chip 2*a* and the center electrode 2 formed by the annular beam welding, as described above. The annular beam welding is, as described above, achieved by irradiating the single annular condensed laser beam 112 to overall circumferences of the ends of the noble metal chip 2*a* and the center electrode 2 to be welded together, therefore, they are melted and solidified instantaneously, so that a single fused portion 10 is formed at the joint of the noble metal chip 2*a* and the center electrode 2 which continues over the circumferential direction of the noble metal chip 2*a*.

We performed durability tests on spark plug samples in which the noble metal chip 2*a* is joined to the center electrode 2 by the annular beam welding under the same conditions as discussed in the first embodiment. Results of the tests are shown in the graph of FIG. 7 by "□". The graph shows that the spark plug samples in this embodiment are lower in fused portion separation percentage than the spark plug samples in the first embodiment. This is because the laser beam 112 used in the annular beam welding is, as described above, uniform in energy density in the circumferential direction thereof, so that a variation in composition of the fused portion 10 is smaller than that in the first embodiment.

Figure 11:
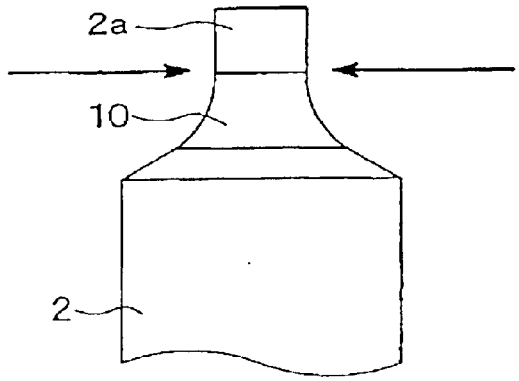
FIG. 11 is a partially enlarged view which shows a weld between a noble metal chip and a center electrode formed in laser welding according to the third embodiment of the invention.
Figure 12:
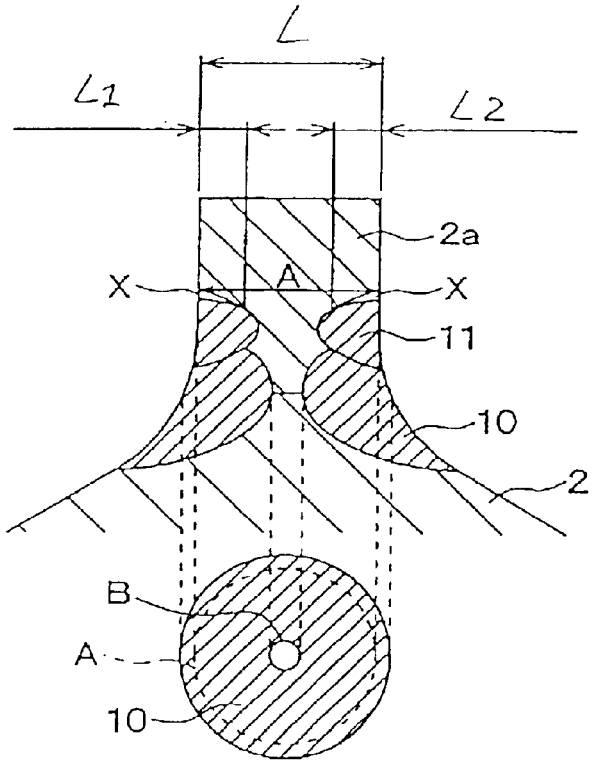
FIG. 12 is a partially longitudinal sectional view which shows an internal structure of the weld in FIG. 11.

FIGS. 11 and 12 show a joint between the noble metal chip 2*a* and the center electrode 2 formed by laser welding according to the third embodiment of the invention. The laser welding of this embodiment is to reradiate a laser beam(s) to an interface between the noble metal chip 2*a* and the fused portion 10 after the annular beam welding as discussed in the second embodiment, thereby forming a second fused portion 11, as illustrated in FIG. 12, made of materials of the fused portion 10 and the noble metal chip 2*a* melted together.

Figure 13:
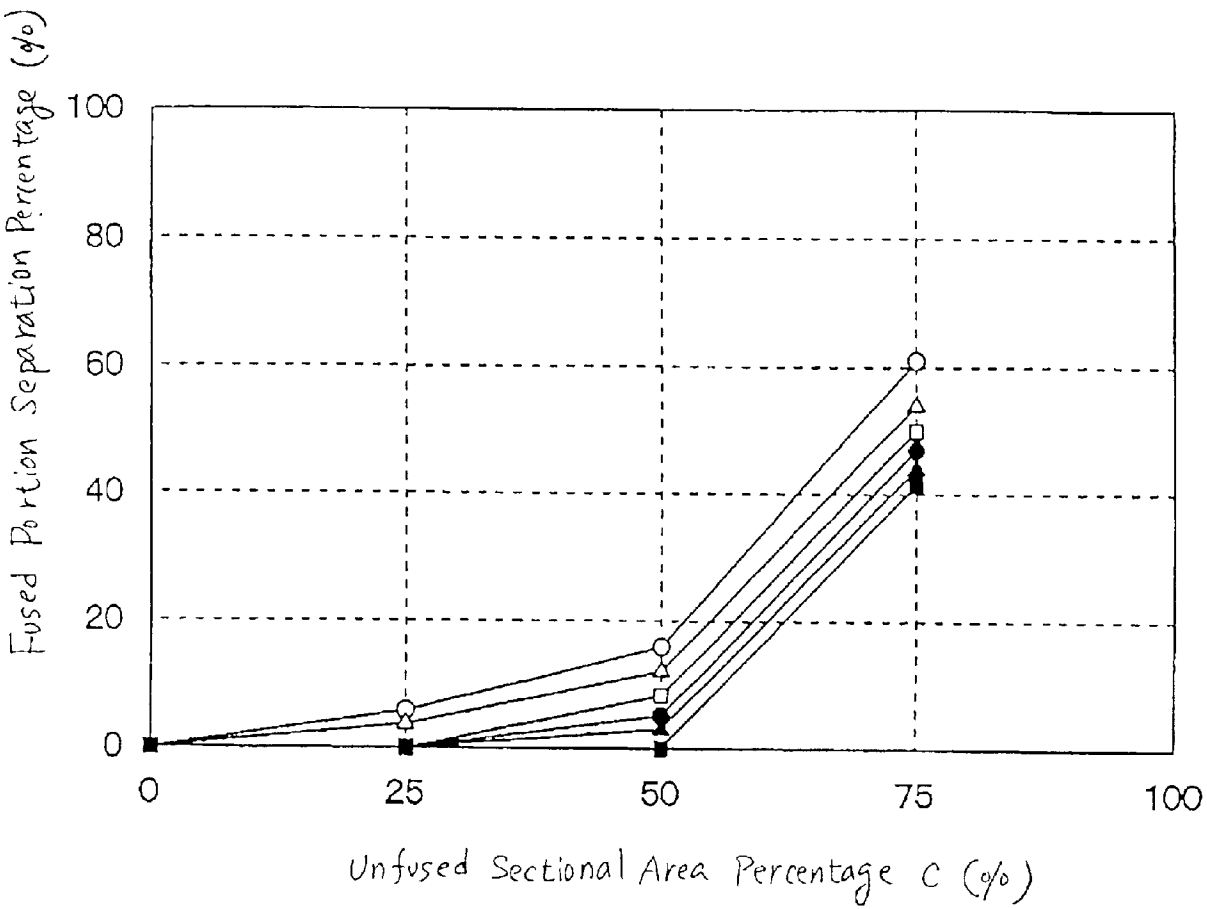
FIG. 13 is a graph which represents a separation percentage of a portion of an interface between the noble metal chip and the weld, as illustrated in FIGS. 11 and 12, which is separated after durability tests for different values of a unwelded area.

We prepared and performed durability tests on six kinds of spark plug samples: the first having the noble metal chip 2*a* welded to the center electrode 2 without the reradiation of the laser beams, the second having the second fused portion 11 formed by radiation of a single laser beam, the third having the second fused portion 11 formed by radiation of two laser beams, the fourth having the second fused portion 11 formed by radiation of four laser beams, the fifth having the second fused portion 11 formed by radiation of eight laser beams, and the sixth having the second fused portion 11 formed by the annular beam welding. The noble metal chip 2*a* and the center electrode 2 used in each spark plug sample are identical in size and material with the ones discussed in first embodiment. Test conditions are the same as those in the first and second embodiments. After the durability tests, we evaluated the durability of the first to fifth spark plug samples which is shown in FIG. 13. In FIG. 13, "○" indicates the above described first spark plug samples. "Δ" indicates the second spark plug samples. "□" indicates the third spark plug samples. "●" indicates the fourth spark plug samples. "▲" indicates the fifth spark plug samples. "■" indicates the sixth spark plug samples.

The graph of FIG. 13 shows that all the second to sixth spark plug samples are lower in the fused portion separation percentage than the first spark plug samples in which the second fused portion 11 is not formed regardless of the unfused sectional area percentage C. This is because the reradiation of a laser beam(s) to the interface between the fused portion 10 and the noble metal chip 2*a* results in an increase in overall thickness of the weld between, the noble metal chip 2*a* and the center electrode 2 and a decreased difference in linear expansivity between the weld and the noble metal chip 2*a*, thus decreasing undesirable local thermal stress produced by the laser welding. The greater the number of laser beams, the lower the fused portion separation percentage. This is because an increase in laser beam radiated to the interface between the fused portion 10 and the noble metal chip 2*a* will result in an increased total volume of a fused portion(s) formed thereby.

Figure 14:
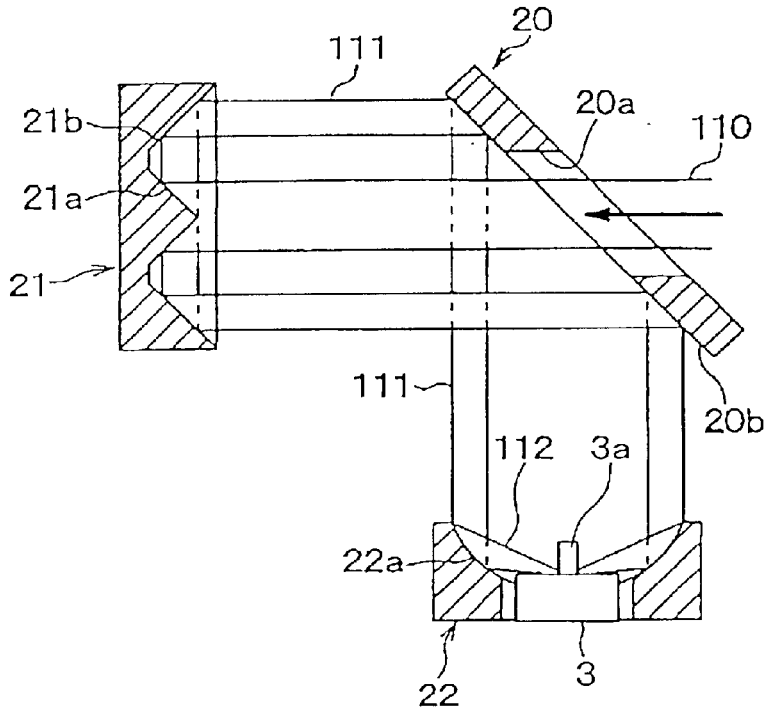
FIG. 14 is a plan view which shows an optical system used in laser welding according to the fourth embodiment of the invention.

FIG. 14 shows an optical system used in laser welding according to the fourth embodiment of the invention which consists essentially of a reflective mirror plate 20, a conical reflective mirror 21, and a condenser mirror 22. This system is different from the one shown in FIG. 8 only in that the radius of curvature of the reflective surface 22*a* of the reflective mirror plate 20 is selected for laser-welding a noble metal chip 3*a* to a surface of the ground electrode 3 opposed to the center electrode 2. Other arrangements and operations are identical, and explanation thereof in detail will be omitted here.

Figure 15:
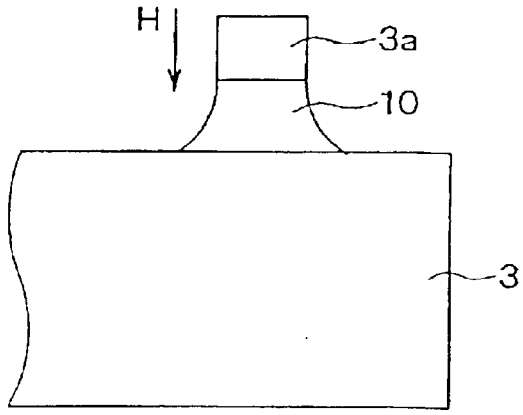
FIG. 15 is a partially enlarged view which shows a weld between a noble metal chip and a center electrode formed by the optical system of FIG. 14.
Figure 16:
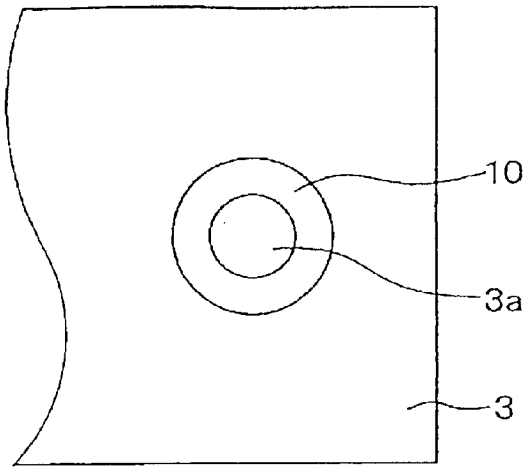
FIG. 16 is a top view as viewed from an arrow H in FIG. 15.

The noble metal chip 3*a* is made of, for example, iridium and joined to the ground electrode 3 by the annular beam welding. Specifically, the annular condensed laser beam 112 is radiated to an overall circumference of a contact between the noble metal chip 3*a* and the ground electrode 3 to be welded to form the fused portion 10, as shown in FIGS. 15 and 16, which continues in the circumferential direction of the noble metal chip 3*a*.

The noble metal chip 3*a* may alternatively be joined to the ground electrode 3 using the multi-spot simultaneous welding.

FIGS. 17 to 20 show laser welding according to the fifth embodiment of the invention which is useful in a case where the metal shell 4 is an obstacle to welding the noble metal chip 3*a* to the ground electrode 3.

Figure 17:
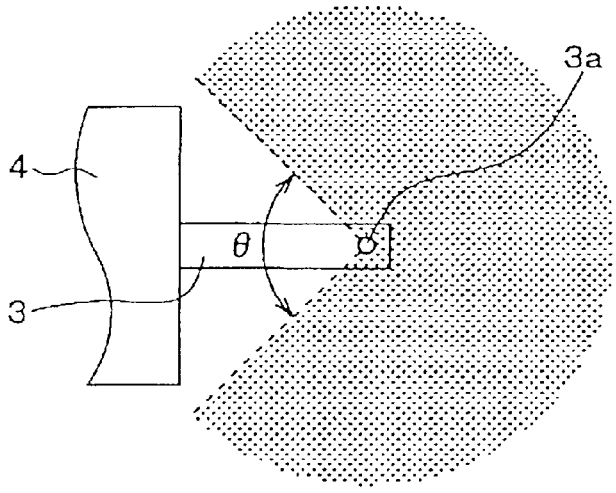
FIG. 17 is a top view which shows laser welding according to the fifth embodiment of the invention.
Figure 18:
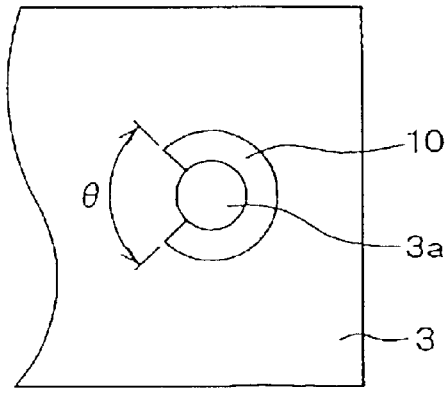
FIG. 18 is a top view which shows a range of a weld between a noble metal chip and a ground electrode formed in a fist step of laser welding of the fifth embodiment.
Figure 19:
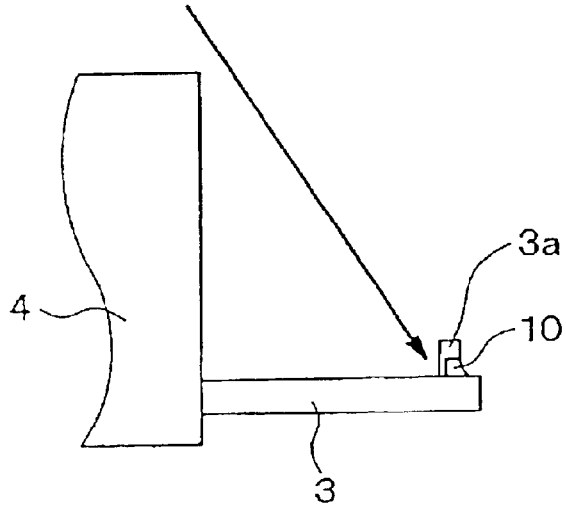
FIG. 19 is a side view which shows the orientation of a laser beam irradiated to an unwelded portion of a noble metal chip in a second step of laser welding of the fifth embodiment.
Figure 20:
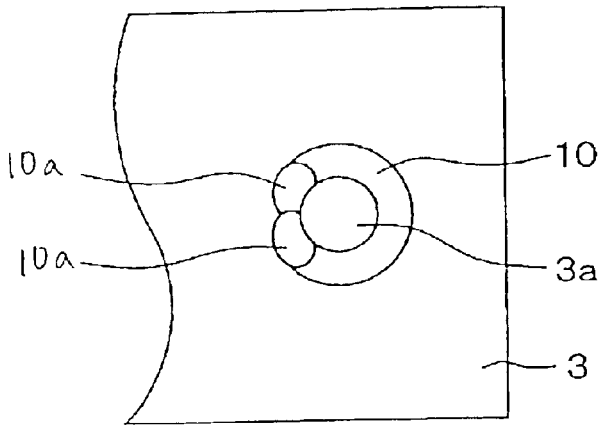
FIG. 20 is a top view of FIG. 19.

When laser beams are irradiated, as shown in FIG. 17, to the overall circumference of the noble metal chip 3*a* from directions substantially perpendicular to a lengthwise direction of the noble metal chip 3*a*, the metal shell 4 will be obstacle within an angular range θ. Therefore, in a case of the multi-spot simultaneous welding, a laser optical system in which laser beam irradiating ports are not arrayed within the angular range θ is used. In a case of the annular beam welding, a laser optical system designed to shield the angular range θ from a laser beam using a masking member is used. Using either system, the fused portion 10, as shown in FIG. 18, is formed except for the angular range θ. Subsequently, a laser(s) is irradiated, as shown in FIG. 19, from above the metal shell 4 to an unwelded area of the noble metal chip 3*a*. In this embodiment, two laser beams are directed to the noble metal chip 3*a* from outside the metal shell 4 at a given angle to a longitudinal center line of the noble metal chip 3*a*, thereby forming fused portions 10*a* over the area of the noble metal chip 3*a* unwelded in the first welding step.

Figure 21:
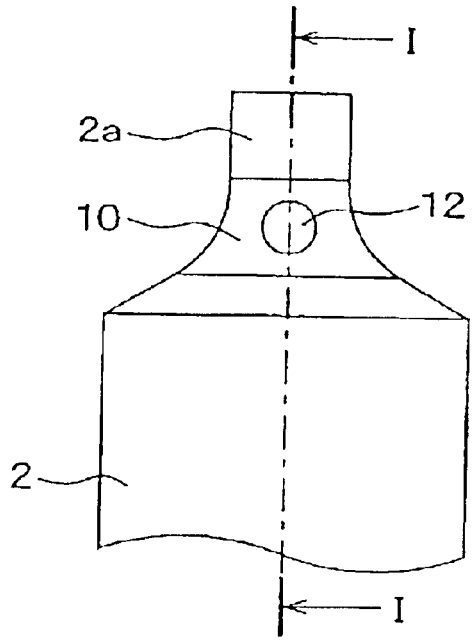
FIG. 21 is a partially enlarged view which shows a weld between a noble metal chip and a center electrode formed in laser welding according to the sixth embodiment of the invention.
Figure 22:
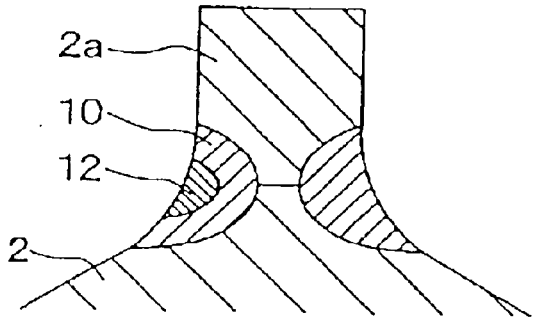
FIG. 22 is a partially longitudinal sectional view, as taken along the line I—I in FIG. 21, which shows an internal structure of the weld in FIG. 21.

FIGS. 21 and 22 show a weld between the noble metal chip 2*a* and the center electrode 2 formed by laser welding according to the sixth embodiment of the invention.

The laser welding of this embodiment is achieved by irradiating a laser beam(s) to the fused portion 10 after being formed by either of the multi-spot simultaneous welding and the annular beam welding, thereby forming at least one second fused portion 12. The second fused portion 12 may be used as an orientation mark indicative of a preselected angular position of the center electrode 2 relative to the ground electrode 3.

Figure 23:
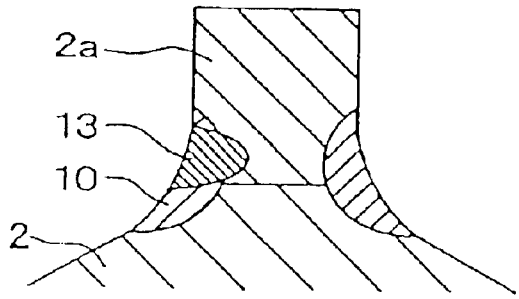
FIG. 23 is a partially longitudinal sectional view which shows an internal structure of a weld between a noble metal chip and a center electrode formed by laser welding according to the seventh embodiment of the invention.

FIG. 23 shows a weld between the noble metal chip 2*a* and the center electrode 2 formed by laser welding according to the seventh embodiment of the invention.

The laser welding of this embodiment is different from the sixth embodiment of FIGS. 21 and 22 only in that at least one second fused portion 13 is formed in the fused portion 10 which extends from an outer surface of the fused portion 10 to inside the noble metal chip 2*a*. Other welding operations are identical, and explanation thereof in detail will be omitted here.

The tip of the second fused portion(s) 13 sticks, like a wedge, in the noble metal chip 2*a*, thereby avoiding dislodgement of the noble metal chip 2*a* even if the fused portion 10 has peeled off the noble metal chip 2*a* at an interface therebetween.

Figure 24:
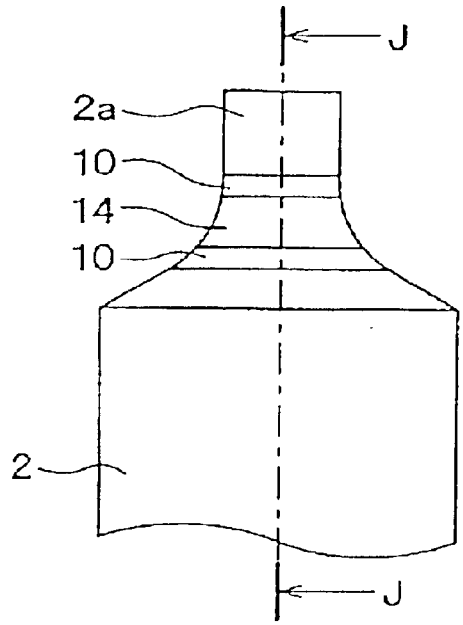
FIG. 24 is a partially enlarged view which shows a weld between a noble metal chip and a center electrode formed in laser welding according to the eighth embodiment of the invention.
Figure 25:
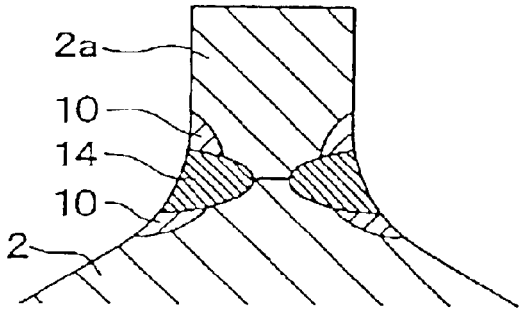
FIG. 25 is a partially longitudinal sectional view, as taken along the line J—J in FIG. 24, which shows an internal structure of the weld in FIG. 24.

FIGS. 24 and 25 show a weld between the noble metal chip 2*a* and the center electrode 2 formed by laser welding according to the eighth embodiment of the invention.

The laser welding of this embodiment is to perform either of the multi-spot simultaneous welding and the annular beam welding to form a second fused portion 14 in the fused portion 10 formed by either of the multi-spot simultaneous welding and the annular beam welding. The second fused portion 14 is formed in, for example, an interface between the noble metal chip 2*a* and the center electrode 2 over a circumferential direction thereof and extends inside the noble metal chip 2*a* and the center electrode 2, thereby resulting in an increased total volume of the weld between the noble metal chip 2*a* and the center electrode 2, which enhances the activity of the weld (i.e., the fused portions 10 and 14) as a thermal stress absorber.

Figure 26:
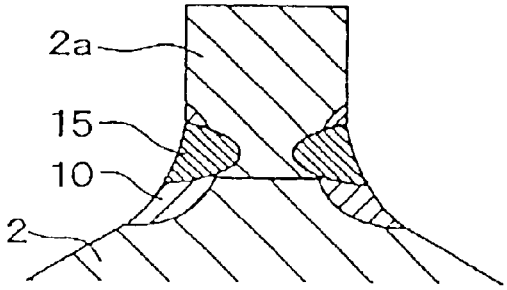
FIG. 26 is a partially longitudinal sectional view which shows an internal structure of a weld between a noble metal chip and a center electrode formed by laser welding according to the ninth embodiment of the invention.

FIG. 26 shows a weld between the noble metal chip 2*a* and the center electrode 2 formed by laser welding according to the ninth embodiment of the invention.

This embodiment is different from the eighth embodiment, as discussed in FIGS. 24 and 25, only in that a second fused portion 15 formed in an overall circumference of the fused portion 10 by either of the multi-spot simultaneous welding and the annular beam welding extends from an outer surface of the fused portion 10 to inside the noble metal chip 2*a*. Other welding operations are identical, and explanation thereof in detail will be omitted here.

The tip of the second fused portion 15 sticks, like a wedge, in the noble metal chip 2*a*, thereby avoiding dislodgement of the noble metal chip 2*a* even if the fused portion 10 has peeled off the noble metal chip 2*a* at an interface therebetween.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims. For instance, the laser welding, as described in some of the above embodiments, used to join the noble metal chip 2*a* to the center electrode 2 may also be employed in welding the noble metal chip 3*a* to the ground electrode 3. Both the noble metal chips 2*a* and 3*a* may be installed on the center and ground electrodes 2 and 3 by the same laser welding manner. Further, each of the noble metal chips 2*a* and 3*a* may be made from a material which contains a main component of 50 Wt % Ir or more and an additive of at least one of Pt, Rh, Os, Ni, W, Pd, and Ru or a main component of 50 Wt % of Pt or more and an additive of at least one of Ir, Rh, Os, Ni, W, Pd, and Ru. The noble metal chips 2*a* and 3*a* used in the above embodiments are each formed by a cylindrical pole, but however, may alternatively be made of a square or triangle pole or a spherical member.

What is claimed is:

1. A spark plug comprising:

a first electrode;

a second electrode opposed to the first electrode through a given air gap;

a noble metal member being in contact of a preselected portion thereof with a preselected portion of at least one of said first and second electrodes, said noble metal member being joined at a contact between said preselected portions with the one of said first and second electrodes by laser welding; and a fused portion that forms a weld between said noble metal member and the one of said first and second electrodes and is made of materials of said noble metal member and the one of said first and second electrodes fused together by the laser welding, said fused portion continuing over at least half a circumferential direction of the contact between said preselected portions of said noble metal member and the one of said first and second electrodes without interfaces of welds.

2. A spark plug as set forth in claim 1, wherein said fused portion continues over an overall circumference of the contact between said preselected portions of said noble metal member and the one of said first and second electrodes.

3. A spark plug as set forth in claim 1, wherein if a sectional area of said noble metal member closest to said fused portion is defined as A, an area of a portion of the contact between said preselected portions of said noble metal member and the one of said first and second electrodes which is unfused by the laser welding is defined as B, a percentage, as expressed by (B/A)×100, is 50% or less.

4. A spark plug as set forth in claim 1, further comprising a second fused portion made of materials of said noble metal member and said fused portion fused together by laser welding, said second fused portion extending into an interface between said fused portion and said noble metal member.

5. A spark plug as set forth in claim 1, wherein said noble metal member is made of an Ir alloy containing at least 50 Wt % of iridium.

6. A spark plug comprising:

a first electrode;

a second electrode opposed to the first electrode through a given air gap;

a noble metal member being in contact of a preselected portion thereof with a preselected portion of at least one of said first and second electrodes, said noble metal member being joined at a contact between said preselected portions with the one of said first and second electrodes by a multi-spot simultaneous laser welding; and a fused portion that forms a weld between said noble metal member and the one of said first and second electrodes and is made of materials of said noble metal member and the one of said first and second electrodes fused together by the multi-spot simultaneous laser welding, said fused portion continuing over at least half a circumferential direction of the contact between said preselected portions of said noble metal member and the one of said first and second electrodes without interfaces of welds.

7. A spark plug as set forth in claim 6, wherein said fused portion continues over an overall circumference of the contact between said preselected portions of said noble metal member and the one of said first and second electrodes.

8. A spark plug as set forth in claim 6, wherein if a sectional area of said noble metal member closest to said fused portion is defined as A, an area of a portion of the contact between said preselected portions of said noble metal member and the one of said first and second electrodes which is unfused by the laser welding is defined as B, a percentage, as expressed by (B/A)×100, is 50% or less.

9. A spark plug as set forth in claim 6, further comprising a second fused portion made of materials of said noble metal member and said fused portion fused together by multi-spot simultaneous laser welding, said second fused portion extending into an interface between said fused portion and said noble metal member.

10. A spark plug as set forth in claim 6, wherein said noble metal member is made of an Ir alloy containing at least 50 Wt % of iridium.

11. A spark plug comprising:

a first electrode;

a second electrode opposed to the first electrode through a given air gap;

a noble metal member being in contact of a preselected portion thereof with a preselected portion of at least one of said first and second electrodes, said noble metal member being joined at a contact between said preselected portions with the one of said first and second electrodes by an annular laser beam welding; and a fused portion that forms a weld between said noble metal member and the one of said first and second electrodes and is made of materials of said noble metal member and the one of said first and second electrodes fused together by the annular laser beam welding, said fused portion continuing over at least half a circumferential direction of the contact between said preselected portions of said noble metal member and the one of said first and second electrodes without interfaces of welds.

12. A spark plug as set forth in claim 11, wherein said fused portion continues over an overall circumference of the contact between said preselected portions of said noble metal member and the one of said first and second electrodes.

13. A spark plug as set forth in claim 11, wherein if a sectional area of said noble metal member closest to said fused portion is defined as A, an area of a portion of the contact between said preselected portions of said noble metal member and the one of said first and second electrodes which is unfused by the laser welding is defined as B, a percentage, as expressed by (B/A)×100, is 50% or less.

14. A spark plug as set forth in claim 11, further comprising a second fused portion made of materials of said noble metal member and said fused portion fused together by annular laser beam welding, said second fused portion extending into an interface between said fused portion and said noble metal member.

15. A spark plug as set forth in claim 11, wherein said noble metal member is made of an Ir alloy containing at least 50 Wt % of iridium.

* * * * *